US009376889B2

(12) United States Patent
Reid et al.

(10) Patent No.: US 9,376,889 B2
(45) Date of Patent: Jun. 28, 2016

(54) DOWNHOLE VALVE ASSEMBLY

(71) Applicant: HALLIBURTON MANUFACTURING & SERVICES LIMITED, Leatherhead (GB)

(72) Inventors: Michael Adam Reid, Kingswell (GB); Gary Henry Smith, Oldmeldrum (GB)

(73) Assignee: Halliburton Manufacturing & Services Limited, Leatherhead (GB)

( * ) Notice: Subject to any disclaimer, the term of this patent is extended or adjusted under 35 U.S.C. 154(b) by 683 days.

(21) Appl. No.: 13/648,567

(22) Filed: Oct. 10, 2012

(65) Prior Publication Data

US 2013/0087344 A1 Apr. 11, 2013

(30) Foreign Application Priority Data

Oct. 11, 2011 (GB) ..... 1117511.4

(51) Int. Cl.
*E21B 34/06* (2006.01)
*E21B 34/14* (2006.01)

(52) U.S. Cl.
CPC ..... *E21B 34/06* (2013.01); *E21B 34/066* (2013.01); *E21B 34/14* (2013.01)

(58) Field of Classification Search
CPC .... E21B 2034/007; E21B 34/06; E21B 34/14
See application file for complete search history.

(56) References Cited

U.S. PATENT DOCUMENTS 1,448,818 A * 3/1923 Stokes ..... 175/84
2,042,817 A 6/1936 Wilcox
2,599,774 A 6/1952 Ohls
2,710,655 A 6/1955 Haskell
2,883,146 A 4/1959 Knox (Continued)

FOREIGN PATENT DOCUMENTS

CA 2485810 4/2005
EP 0427371 5/1991

(Continued)

OTHER PUBLICATIONS

UK Intellectual Property Office, Search Report of UK Patent Application No. GB 1117511.4 (foreign priority application), Jan. 22, 2012. Search Report issued in connection with UK priority patent application prior to filing instant U.S. patent application.

(Continued)

*Primary Examiner* — David Andrews
(74) *Attorney, Agent, or Firm* — Benjamin Fite; Fish & Richardson P.C.

(57) ABSTRACT

A downhole valve assembly operable to control production fluid flow around an obstruction in a production tubing string. The obstruction may be caused by another valve or valve assembly located in the production tubing string, where the valve is closed and blocks flow through the production tubing. The downhole valve assembly comprises a tubular body that includes an axial passage extending through the body and one or more ports extending substantially radially through the body. The downhole valve assembly also includes one or more actuating members operable to move relative to the body. Movement of the actuating members selectively opens the ports such that a fluid flow path through the ports is defined between an annulus region outside of the valve assembly and the axial passage such that the blockage can be bypassed.

21 Claims, 11 Drawing Sheets

(56) References Cited

U.S. PATENT DOCUMENTS

| | | | | |
|---|---|---|---|---|
| 2,916,254 | A | 12/1959 | Wendell | |
| 3,072,379 | A | 1/1963 | Hamer | |
| 3,241,808 | A | 3/1966 | Allen | |
| 3,395,758 | A | 8/1968 | Kelly et al. | |
| 3,424,190 | A | 1/1969 | Wolfensperger | |
| 3,472,484 | A | 10/1969 | Parker | |
| 3,503,445 | A | 3/1970 | Cochrum et al. | |
| 3,581,820 | A | 6/1971 | Burns | |
| 3,675,718 | A | 7/1972 | Kanady | |
| 3,732,925 | A | 5/1973 | Kanady | |
| 3,815,676 | A | 6/1974 | Read | |
| 3,960,363 | A | 6/1976 | Domyan | |
| 3,061,267 | A | 10/1976 | Hamer | |
| 3,993,130 | A | 11/1976 | Papp | |
| 4,022,426 | A | 5/1977 | Read | |
| 4,022,427 | A | 5/1977 | Read | |
| 4,029,292 | A | 6/1977 | Kramer et al. | |
| 4,080,982 | A | 3/1978 | Maezawa | |
| 4,119,146 | A | 10/1978 | Taylor | |
| 4,249,599 | A | 2/1981 | Krause | |
| 4,281,715 | A * | 8/1981 | Farley | 166/317 |
| 4,315,542 | A | 2/1982 | Dockins, Jr. | |
| 4,355,685 | A | 10/1982 | Beck | |
| 4,406,335 | A | 9/1983 | Koot et al. | |
| 4,421,174 | A | 12/1983 | McStravick et al. | |
| 4,506,693 | A | 3/1985 | Acker | |
| 4,519,579 | A | 5/1985 | Brestel et al. | |
| 4,606,368 | A | 8/1986 | McCafferty | |
| 4,616,857 | A | 10/1986 | Woodman et al. | |
| 4,700,924 | A | 10/1987 | Nelson et al. | |
| 4,709,762 | A | 12/1987 | Pringle et al. | |
| 4,776,395 | A | 10/1988 | Baker et al. | |
| 4,782,896 | A | 11/1988 | Witten | |
| 4,796,705 | A | 1/1989 | Carmody et al. | |
| 4,815,701 | A | 3/1989 | Stone | |
| 4,903,775 | A | 2/1990 | Manke | |
| 4,921,044 | A | 5/1990 | Cooksey | |
| 4,949,788 | A | 8/1990 | Szarka et al. | |
| 4,991,654 | A * | 2/1991 | Brandell et al. | 166/332.7 |
| 5,101,907 | A | 4/1992 | Schultz et al. | |
| 5,263,683 | A | 11/1993 | Wong | |
| 5,316,084 | A | 5/1994 | Murray et al. | |
| 5,529,126 | A | 6/1996 | Edwards | |
| 5,547,029 | A | 8/1996 | Rubbo et al. | |
| 5,615,548 | A | 4/1997 | Winfree et al. | |
| 5,865,246 | A | 2/1999 | Brown | |
| 5,875,852 | A | 3/1999 | Floyd et al. | |
| 5,911,285 | A | 6/1999 | Stewart et al. | |
| 6,003,834 | A | 12/1999 | Read | |
| 6,041,864 | A | 3/2000 | Patel et al. | |
| 6,044,908 | A | 4/2000 | Wyatt | |
| 6,145,595 | A | 11/2000 | Burris | |
| 6,276,458 | B1 | 8/2001 | Malone et al. | |
| 6,298,919 | B1 | 10/2001 | Browne et al. | |
| 6,308,783 | B2 | 10/2001 | Pringle et al. | |
| 6,315,047 | B1 | 11/2001 | Deaton et al. | |
| 6,450,255 | B2 | 9/2002 | Carmody et al. | |
| 6,550,541 | B2 | 4/2003 | Patel | |
| 6,575,237 | B2 | 6/2003 | Purkis et al. | |
| 6,668,936 | B2 | 12/2003 | Williamson et al. | |
| 6,684,950 | B2 | 2/2004 | Patel | |
| 6,715,558 | B2 | 4/2004 | Williamson | |
| 6,776,240 | B2 | 8/2004 | Kenison et al. | |
| 6,782,952 | B2 | 8/2004 | Garay et al. | |
| 6,860,330 | B2 | 3/2005 | Jackson | |
| 6,880,638 | B2 | 4/2005 | Haughom et al. | |
| 6,951,331 | B2 | 10/2005 | Haughom et al. | |
| 6,974,121 | B2 | 12/2005 | Koester et al. | |
| 7,204,315 | B2 | 4/2007 | Pia | |
| 7,258,323 | B2 | 8/2007 | Dwivedi | |
| 7,306,043 | B2 | 12/2007 | Toekje et al. | |
| 7,597,150 | B2 | 10/2009 | Clem | |
| 7,614,452 | B2 | 11/2009 | Kenison et al. | |
| 7,690,432 | B2 | 4/2010 | Noske et al. | |
| 8,316,953 | B2 | 11/2012 | Reid | |
| 8,602,112 | B2 | 12/2013 | Reid | |
| 2002/0046845 | A1 | 4/2002 | Rayssiguier et al. | |
| 2002/0053438 | A1 | 5/2002 | Williamson, Jr. | |
| 2002/0066574 | A1 | 6/2002 | Leismer et al. | |
| 2003/0047702 | A1 | 3/2003 | Gunnarsson et al. | |
| 2004/0035578 | A1 | 2/2004 | Ross et al. | |
| 2004/0041120 | A1 | 3/2004 | Haughom et al. | |
| 2004/0046143 | A1 | 3/2004 | Haughom et al. | |
| 2004/0112608 | A1 | 6/2004 | Jackson | |
| 2004/0154839 | A1 | 8/2004 | McGarian et al. | |
| 2005/0087344 | A1 | 4/2005 | Toekje et al. | |
| 2005/0151107 | A1 | 7/2005 | Shu | |
| 2005/0224235 | A1 | 10/2005 | Patel | |
| 2005/0230118 | A1 | 10/2005 | Noske et al. | |
| 2007/0102163 | A1 | 5/2007 | Heath et al. | |
| 2007/0187106 | A1 | 8/2007 | Wolters | |
| 2007/0187107 | A1 | 8/2007 | Pringle | |
| 2007/0204999 | A1 | 9/2007 | Cowie et al. | |
| 2008/0203346 | A1 | 8/2008 | Shu | |
| 2009/0050335 | A1 | 2/2009 | Mandrou | |
| 2009/0071658 | A1 | 3/2009 | Reid et al. | |
| 2009/0288838 | A1 | 11/2009 | Richards | |
| 2010/0071962 | A1 * | 3/2010 | Beuershausen | 175/399 |
| 2011/0000679 | A1 | 1/2011 | Joseph et al. | |
| 2011/0061875 | A1 | 3/2011 | Tips et al. | |
| 2011/0203809 | A1 | 8/2011 | Knobloch, Jr. et al. | |
| 2012/0261137 | A1 | 10/2012 | Martinez et al. | |
| 2012/0312547 | A1 | 12/2012 | Miller | |
| 2013/0000922 | A1 | 1/2013 | Skinner et al. | |
| 2013/0087341 | A1 | 4/2013 | Reid | |
| 2013/0092380 | A1 | 4/2013 | Reid | |
| 2013/0098624 | A1 | 4/2013 | Reid | |

FOREIGN PATENT DOCUMENTS

| | | |
|---|---|---|
| EP | 1136649 | 9/2001 |
| EP | 1241322 | 3/2002 |
| EP | 1350007 | 10/2005 |
| EP | 1350008 | 10/2005 |
| GB | 939999 | 10/1963 |
| GB | 2201979 | 9/1988 |
| GB | 2293433 | 3/1996 |
| GB | 2344152 | 5/2000 |
| GB | 2377743 | 1/2003 |
| GB | 2388854 | 11/2003 |
| GB | 2396633 | 6/2004 |
| GB | 2397316 | 7/2004 |
| GB | 2411677 | 9/2005 |
| GB | 2425585 | 11/2006 |
| GB | 2434814 | 8/2007 |
| GB | 2451288 | 1/2009 |
| GB | 2473092 | 3/2011 |
| WO | WO99/45231 | 9/1999 |
| WO | WO01/86113 | 11/2001 |
| WO | WO03/001019 | 1/2003 |
| WO | WO2004057689 | 7/2004 |
| WO | WO2005052302 | 6/2005 |
| WO | WO2005052313 | 6/2005 |
| WO | WO2009033018 | 3/2009 |
| WO | WO2009132462 | 11/2009 |
| WO | WO 2010/129631 | 11/2010 |
| WO | WO 2011/002676 | 1/2011 |
| WO | WO2011002676 | 1/2011 |
| WO | WO 2011/072367 | 6/2011 |

OTHER PUBLICATIONS

Examiner Susan Morrish, Extended European Search Report, European Application No. 12185092.9, Mar. 18, 2014, 5 pages.

Extended European Search Report, European Application No. 14195113.7, Mar. 13, 2015, 5 pages.

Fisher Product Bulletin—"Type Vee-Ball Designs V150, V200 and V300", Rotary Control Valves, Apr. 2005.

PCT/GB2006/000669; International Preliminary Report dated Aug. 28, 2007.

PCT/GB2006/000669; International Search Report dated Jun. 14, 2006.

(56) References Cited

OTHER PUBLICATIONS

UK Intellectual Property Office, Search Report of UK Patent Application No. GB 1117502.3 (foreign priority application), Jan. 20, 2012. Search Report issued in connection with UK priority patent application prior to filing instant U.S. patent application.
UK Intellectual Property Office, Search Report of UK Patent Application No. GB 1117505.6 (foreign priority application), Jan. 19, 2012. Search report issued in connection with UK priority application prior to filing instant US patent application.
UK Intellectual Property Office, Search Report of UK Patent Application No. GB 1117507.2 (foreign priority application), Jan. 20, 2012. Search Report issued in connection with UK priority patent application prior to filing instant U.S. patent application.
UK Search Report: Appln. GB1019746.5; Date of Search: Jan. 28, 2011.

* cited by examiner

DOWNHOLE VALVE ASSEMBLY

CROSS REFERENCE TO RELATED APPLICATIONS

The present application claims priority to United Kingdom Patent Application No. GB1117511.4, filed Oct. 11, 2011, and titled DOWNHOLE VALVE ASSEMBLY, the contents of which are expressly incorporated herein by reference.

BACKGROUND OF THE INVENTION

1. Field of the Invention

The present invention relates to a downhole valve assembly. In particular, the present invention relates to a downhole valve assembly that provides a contingency/back-up device in the event that another downhole valve has failed to open.

2. Description of the Related Art

Well completion involves various downhole procedures prior to allowing production fluids to flow thereby bringing the well on line. One of the downhole procedures routinely carried out during well completion is pressure testing where one downhole section of the well is isolated from another downhole section of the well by a closed valve mechanism such that the integrity of the wellbore casing/liner can be tested.

Well completion generally involves the assembly of downhole tubulars and equipment that is required to enable safe and efficient production from a well. In the following, well completion is described as being carried out in stages/sections. The integrity of each section may be tested before introducing the next section. The terms lower completion, intermediate completion and upper completion are used to describe separate completion stages that are fluidly coupled or in fluid communication with the next completion stage to allow production fluid to flow.

Lower completion refers to the portion of the well that is across the production or injection zone and which comprises perforations in the case of a cemented casing such that production flow can enter the inside of the production tubing such that production fluid can flow towards the surface.

Intermediate completion refers to the completion stage that is fluidly coupled to the lower completion and upper completion refers to the section of the well that extends from the intermediate completion to carry production fluid to the surface.

During testing of the intermediate completion stage the lower completion is isolated from the intermediate completion by a closed valve located in the intermediate completion. When the integrity of the tubing forming the intermediate completion section is confirmed the upper completion stage can be run-in.

Generally the completion stages are run-in with valves open and then the valves are subsequently closed such that the completion stages can be isolated from each other and the integrity of the production tubing and the well casing/wall can be tested.

Typically, the valves remain downhole and are opened to allow production fluids to flow. By opening the valves the flow of production fluids is not impeded.

In the event that a valve fails to open, for example where the valve or an actuating mechanism operable to open the valve becomes jammed, remedial action is generally required because a failed valve effectively blocks the production path.

Remedial action often involves removing the valve. The valve may be removed by milling or drilling the valve out of the wellbore to provide a free flowing path for production fluid.

It will be appreciated that resorting to such remedial action can result in costly downtime because production from the well is stopped or delayed. The remedial action may result in damage to the well itself where milling or drilling the valve or valves from the wellbore may create perforations in the production tubing or the well casing or well lining. As a result such actions would preferably be avoided.

It is desirable to provide a downhole device such that production downtime due to a failed valve is reduced.

It is further desirable to provide an improved downhole valve assembly that helps to avoid using remedial actions such as milling or drilling to remove a failed valve from an intermediate or upper completion section of a wellbore.

It is desirable to provide a downhole valve assembly that provides a contingency or back-up system when there is a failed valve located in the wellbore.

BRIEF SUMMARY OF THE INVENTION

A first aspect of the present invention provides a downhole valve assembly operable to control production fluid flow around an obstruction in a production tubing string; wherein the valve assembly comprises a tubular body comprising an axial passage extending through the body; one or more ports extending substantially radially through the body; and one or more actuating members operable to move relative to the body to selectively open the ports such that a fluid flow path through the ports is defined between an annulus region outside of the valve assembly and the axial passage.

The obstruction in the production tubing string may comprise a downhole valve assembly that is closed due to failure to open.

The valve assembly according to the present invention may comprise a mechanically actuated actuating member.

The mechanically actuated actuating member may be adapted for mechanical engagement with a removable downhole tool such that upon removal of the downhole tool the actuating member may be moved from a first position to a second position. When the mechanically actuated actuating member is in the second position the valve assembly may be in a primed state.

Mechanical engagement of the mechanically actuated actuating member with a downhole tool such as a stinger or a washpipe may comprise coupling the mechanically actuated actuating member to the downhole tool. Accordingly, the mechanically actuated actuating member may comprise a coupling member adapted to couple with a corresponding coupling member on the downhole tool. Removal of the downhole tool, for example using a sliding action of the downhole tool in a generally uphole direction, may engage the coupling member of the actuating member with the coupling member of the downhole tool such that the actuating member may be displaced and may disengage from the downhole tool leaving the valve assembly in the primed state.

In the primed state the ports remain closed until a subsequent event, for example, when fluid pressure is applied via the axial passage to the valve assembly. The applied fluid pressure may be within a predetermined range such that unnecessary actuation may be avoided.

The valve assembly may further comprise a hydraulic actuator, comprising at least a piston member and an inlet and an outlet. The inlet of the hydraulic actuator may be in fluid communication with the axial passage of the body. The outlet may be in fluid communication with a hydraulically actuated actuating member that moves when fluid pressure is applied via the inlet.

The inlet of the hydraulic actuator may be closed when the mechanically actuated actuating member is arranged in the first position and may be opened when the mechanically actuated actuating member is arranged in the second position. When the mechanically actuated actuating member is in the second position the inlet of the hydraulic actuator may be open, wherein the hydraulic actuator may be in fluid communication with the axial passage of the body. The inlet of the hydraulic actuator may be in fluid communication with the axial passage when the valve assembly is in the primed state.

The hydraulic actuator may be operable to open the one or more ports upon application of fluid pressure via the inlet when the valve assembly is in the primed state. Hydraulic actuation may be provided by fluid pressure applied via production tubing or annulus such that pressurised fluid enters the inlet of the hydraulic actuator and applies pressure upon the piston member, which acts to displace the hydraulically actuated actuating member thereby opening the ports. The hydraulic actuator may comprise, for example, a spring, an electronically controlled pump, or a hydraulic piston.

The mechanically actuated actuating member and the hydraulic actuator may be arranged within the tubular body. The mechanically actuated actuating member and the hydraulic actuator may be adapted to move by sliding in an axial direction relative to the body.

The hydraulic pressure required to actuate the hydraulic actuator may be applied via the inlet due to fluid pressure from the axial passage or from the annulus.

The hydraulic actuator may comprise one or more fluid openings that each may be aligned with a corresponding port on the tubular body to define the flow path between an annulus region outside of the valve and the axial passage.

The ports through the body may be inclined relative to the axis of the body. The direction of the incline of the ports through the body may correspond substantially with the direction of fluid flow.

The downhole valve assembly according to the present invention provides an alternative flow route for fluid in the event that another downhole valve assembly, for example a barrier valve, has failed to open. Therefore, a valve assembly according to the present invention maintains production flow such that remedial actions such as milling or drilling to remove the obstruction are avoided.

A valve assembly according to a first embodiment of the present invention may restore normal axial flow of fluid following a diversion of fluid flow around the obstruction using the annulus region defined between the inside wall of the well/reservoir and the outside of the tubing mounted completion assembly.

The valve assembly according to the first embodiment of the present invention may be located uphole of the potential obstruction such that restoration of fluid flow passes from the annulus to the axial passage. It will be appreciated that the valve assembly restores normal axial flow before the annulus flow is blocked by a packer.

The valve assembly according to the first embodiment may comprise ports through the body, wherein the ports incline in an uphole direction from outside to inside the body. Therefore the direction of incline may correspond substantially with the direction of fluid flow. Fluid flow through the valve according to the first embodiment of the invention may be from the annulus region outside the body to inside the axial passage. Alternatively, fluid flow through the valve according to a second embodiment may be from inside the axial passage to the annulus region outside of the body.

In respect of the valve assembly according to the first embodiment, annulus flow is necessary to bypass the obstruction. Annulus flow may be generated by fluid flow through perforations in the production tubing in a region downhole of the potential obstruction. Annulus flow may be created by production or injection fluid flowing through the perforations into the annulus region defined between the outside of the production tubing and the inside wall of the well/reservoir.

Alternatively, annulus flow from a region downhole of the valve assembly may be created by a disconnection in the production tubing, for example one tubing mounted completion assembly may be disconnected from another tubing mounted completion assembly such that when production fluid flows it divides at the disconnection to generate flow through the axial passage and in the annulus region.

Alternatively, annulus flow may be created by a valve assembly according to a second embodiment of the invention. The valve assembly according to a second embodiment may be located in a region of the well that is downhole of a potential obstruction.

A valve assembly according to the second embodiment may comprise ports through the body, wherein the ports incline from inside to outside in an uphole direction. Therefore, the direction of incline may correspond substantially with the direction of production fluid flow where production fluid flow through the valve according to a second embodiment of the invention may be from the axial passage inside the body to the annulus region outside the body.

The valve assembly according to the second embodiment may be utilised to create annulus flow such that an obstruction uphole of the valve assembly can be bypassed. Hydraulic actuation of the valve assembly according to the second embodiment of the invention may be provided by annulus flow entering the inlet of the hydraulic actuator and acting upon the piston member, which acts to displace the hydraulically actuated actuating member thereby opening the ports for fluid to flow. The valve assembly according to the second embodiment may be utilised to create annulus flow.

Annulus flow is required to bypass an obstruction in the production tubing. However, in a tubing mounted completion assembly comprising a packer, production fluid flow via the annulus is prevented beyond the packer because the packer seals the annulus region defined between the outside of the production tubing and the inside wall of the well. Therefore, a valve assembly according to the first embodiment may be utilised to restore normal flow by diverting annulus flow back into the axial passage and beyond a packer.

The valve assembly according to embodiments of the invention and all its associated control lines and actuators may be contained within the wellbore as part of a tubing mounted completion assembly and as such operation of the valve assembly may be by application of fluid pressure from uphole or downhole of the valve. Therefore, a valve assembly according to embodiments of the invention does not require any control lines to surface to operate.

The valve assembly according to the present invention may provide a back-up or contingency device to a downhole valve assembly that has failed to open.

A second aspect of the present invention provides a method of controlling and diverting fluid flow around an obstruction in a production tubing string, wherein the method comprises the steps of:

locating a valve assembly in a wellbore, wherein the valve assembly comprises a tubular body comprising an axial passage extending through the body, one or more ports extending substantially radially through the body; and one or more actuating members operable to move relative to the body to selectively open the ports such that a fluid flow path through the ports is defined between an annulus region outside of the valve and the axial passage; and moving the one or more actuating members relative to the body to open the ports such that a fluid flow path for production fluid is defined; wherein the fluid flow path is defined between an annulus region outside of the valve and the axial passage.

The valve may comprise a mechanically actuated actuating member, wherein the method comprises the step of engaging the mechanically actuated actuating member with a retrievable downhole tool, moving the mechanically actuated actuating member from a first position to a second position and disengaging the mechanically actuated actuating member from the retrievable downhole tool. The retrievable downhole tool may be, for example a washpipe or stinger. When the mechanically actuated actuating member is in the second position the valve assembly may be in a primed state.

The valve assembly may further comprise a hydraulic actuator comprising at least a piston member, a fluid inlet and a fluid outlet, wherein the method may further comprise applying fluid pressure via the axial passage or annulus and the inlet such that the fluid pressure may act upon the piston to selectively open the ports such that a fluid flow path for production fluid is defined through the body of the valve assembly.

BRIEF DESCRIPTION OF THE SEVERAL VIEWS OF THE DRAWINGS

Embodiments of the present invention will now be described, by way of example only, with reference to the accompanying drawings, in which.

DETAILED DESCRIPTION OF THE INVENTION

Figure 1:
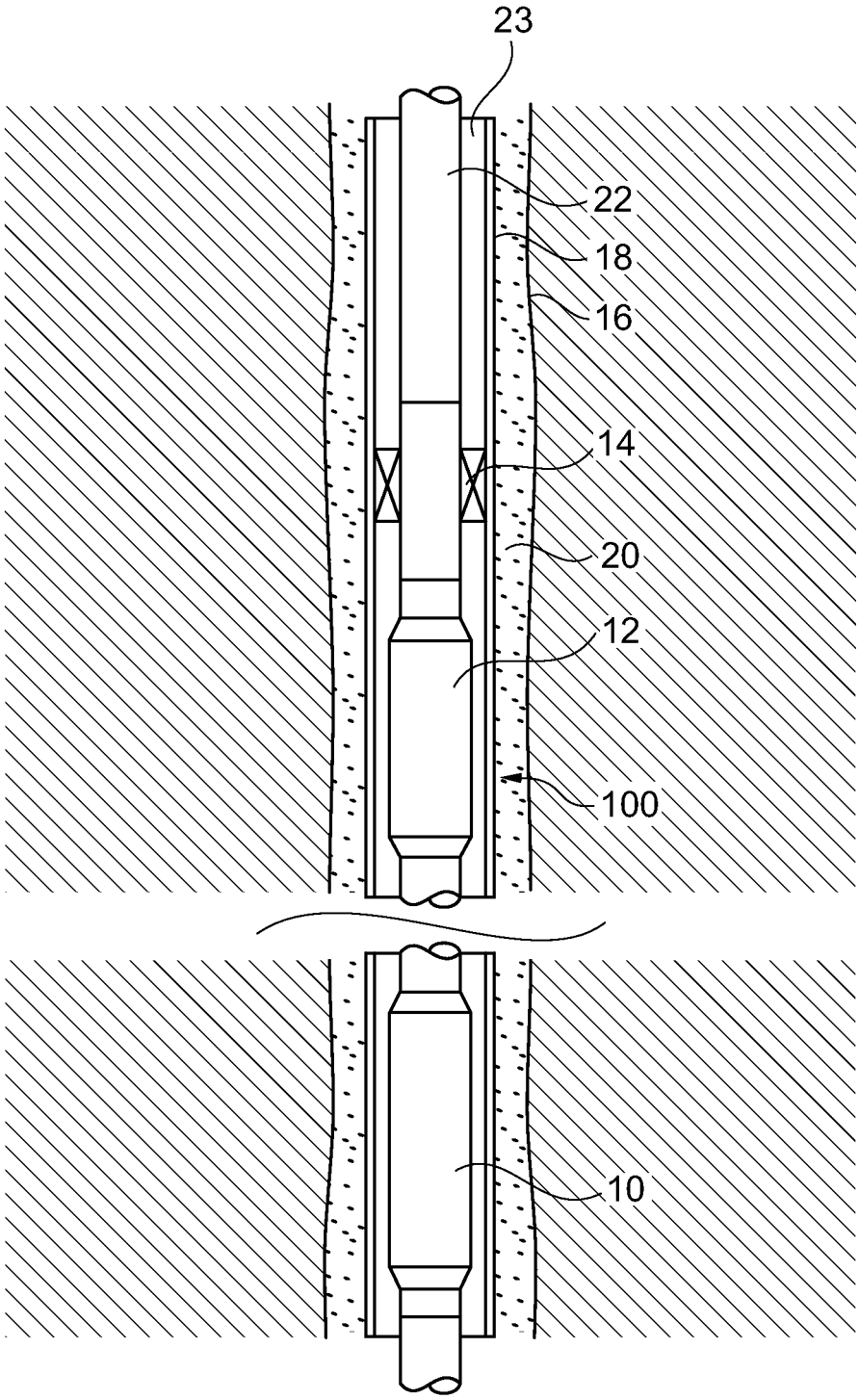
FIG. 1 is a schematic representation of a wellbore assembly comprising a downhole valve assembly in accordance with an embodiment of the present invention.

Referring to FIG. 1, a partial longitudinal view of a wellbore completion arrangement 100 is illustrated. The wellbore completion arrangement 100 comprises a first downhole valve assembly 10, a second downhole valve assembly 12 and a packer assembly 14.

The second downhole valve assembly 12 is representative of a downhole valve assembly in accordance with embodiments of the present invention. The downhole valve assembly 12 will be hereinafter referred to as a bypass valve assembly 12 such that it is distinguishable from the first downhole valve assembly 10, which may be for example a barrier valve.

In the illustrated example, a wellbore 16 is lined with a casing 18, which in the illustrated embodiment is held in place with cement 20.

The downhole valve assembly 10, the bypass valve assembly 12 and the packer assembly 14 are all run into the casing 18 as part of the well completion assembly 100 on a running string that may include a stinger or washpipe (not illustrated).

For illustrative purposes, FIG. 1 does not indicate any specific form or type of downhole valve assembly 10. Suitable valve assemblies 10 will be discussed further below with respect to the action of the bypass valve assembly 12 according to embodiments of the present invention.

The packer assembly 14 provides a seal in the annulus region 23 defined between the outside diameter of the production tubing 22 and the inside diameter of the casing 18.

In the illustrated embodiment the downhole valve assembly 10 is run-in in an open state and is subsequently closed when it has reached its location downhole. Once closed, fluid pressure can be applied from above the downhole valve assembly 10 to check the integrity of the production tubing 22 and the well completion assembly 100. Following successful testing, the downhole valve assembly 10 can be opened such that production fluid can flow unimpeded through the downhole valve assembly 10 when the well is brought on line.

The downhole valve assembly 10 can be opened by suitable means, for example fluid pressure from control lines to surface (not illustrated), mechanical actuation (not illustrated) or remote electronic actuation (not illustrated). Examples of suitable valves are ball valves and flapper valves.

Figure 2:
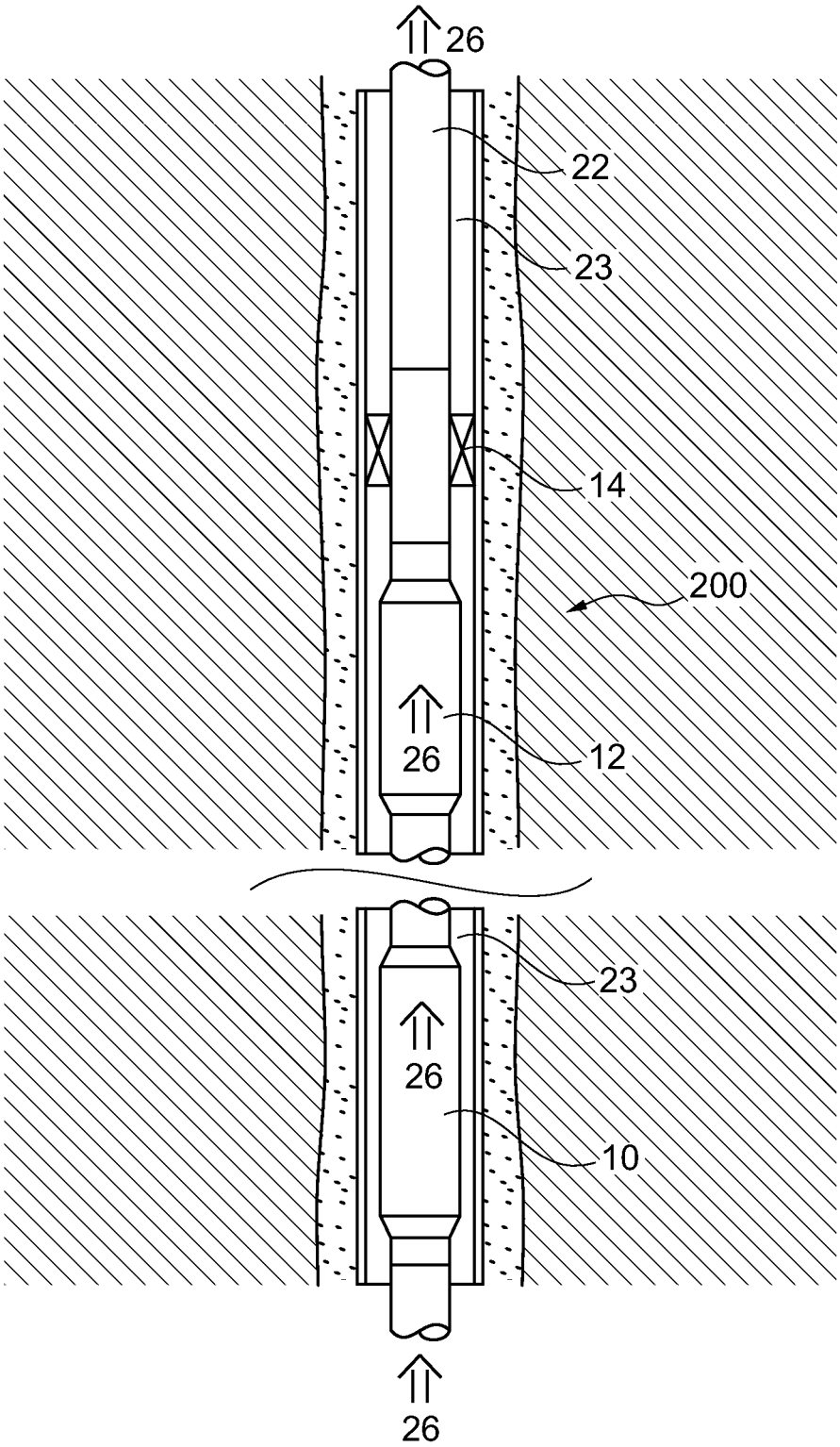
FIG. 2 is a schematic representation of the wellbore assembly of FIG. 1 showing a production flow path during normal operation of a producing well.

FIG. 2 illustrates a producing well 200 comprising a downhole valve assembly 10, a bypass valve assembly 12 and a packer assembly 14, where the well is online and production fluid is flowing from a downhole location towards the surface as indicated by arrows 26. The normal path for production fluid is to flow in the uphole direction, through the axial bore of the production tubing 22 and to pass unimpeded through the open axial bore of the downhole valve assembly 10 and to continue to flow through the axial bore of the production tubing 22 towards the surface as indicated by arrows 26.

Figure 3:
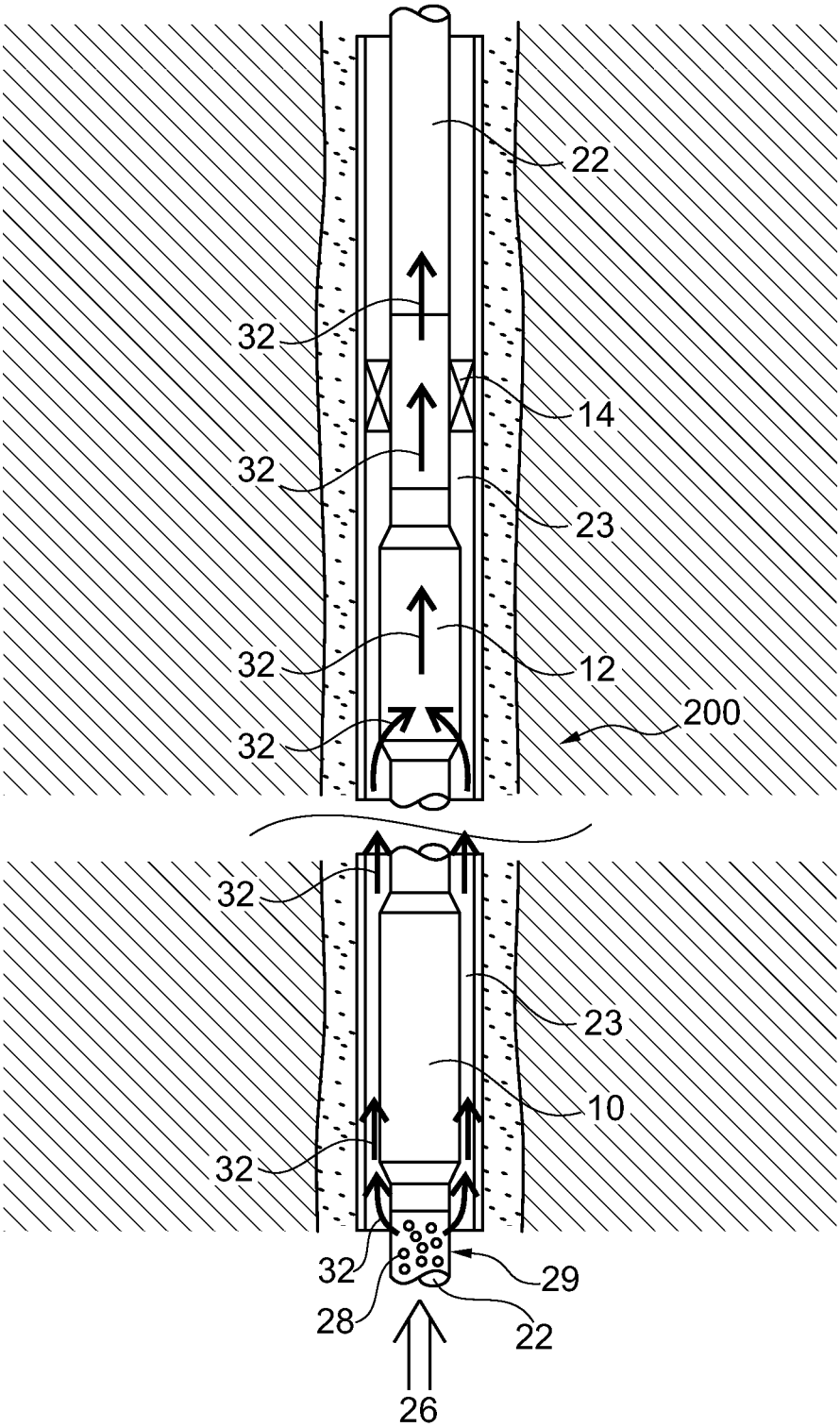
FIG. 3 is a schematic representation of the wellbore assembly of FIG. 1 showing a modified production flow path of a producing well in accordance with an embodiment of the present invention.

FIG. 3 illustrates a producing well 200 in the event that the downhole valve assembly 10 has failed to open and remains closed regardless of further attempts to open the downhole valve assembly 10. In this situation, the bypass valve assembly 12, according to a first embodiment of the present invention, can be used to facilitate a diversion of production fluid flow around the failed valve assembly 10 as illustrated in FIG. 3 and described further below.

Normal flow 26 from a producing well is illustrated in FIG. 2, however in the example illustrated in FIG. 3, the normal flow path 26 for production fluids towards the surface is prevented due to the blockage provided by the closed or failed downhole valve assembly 10.

In the illustrated embodiment, annulus flow, as indicated by arrows 32, is provided from a region downhole of the downhole valve assembly 10.

Perforations 28 through the production tubing 22 in the region downhole of the downhole valve assembly 10 enables annulus flow 32 from the production flow 26. The annulus flow 32 is created by the production flow 26 in the axial bore of the production tubing 22 flowing through the perforations 28 into the annulus 30. Annulus flow 32 is therefore allowed in the particular completion assembly, for example intermediate or upper completion up to the packer assembly 14, which provides an annulus seal and therefore prevents further uphole passage of annulus fluid flow 32 beyond the packer assembly 14.

As is illustrated in FIG. 3, the annulus flow 32 provides a flow path around the failed downhole valve assembly 10.

With reference to FIGS. 3, 4, 5 and 6, the bypass valve assembly 12, according to an embodiment of the invention, facilitates diverting the annulus flow 32 of production fluid 26 from the annulus 23 back into the axial bore of the production tubing 22 in a location uphole of an obstruction caused by the closed valve assembly 10.

Figure 4:
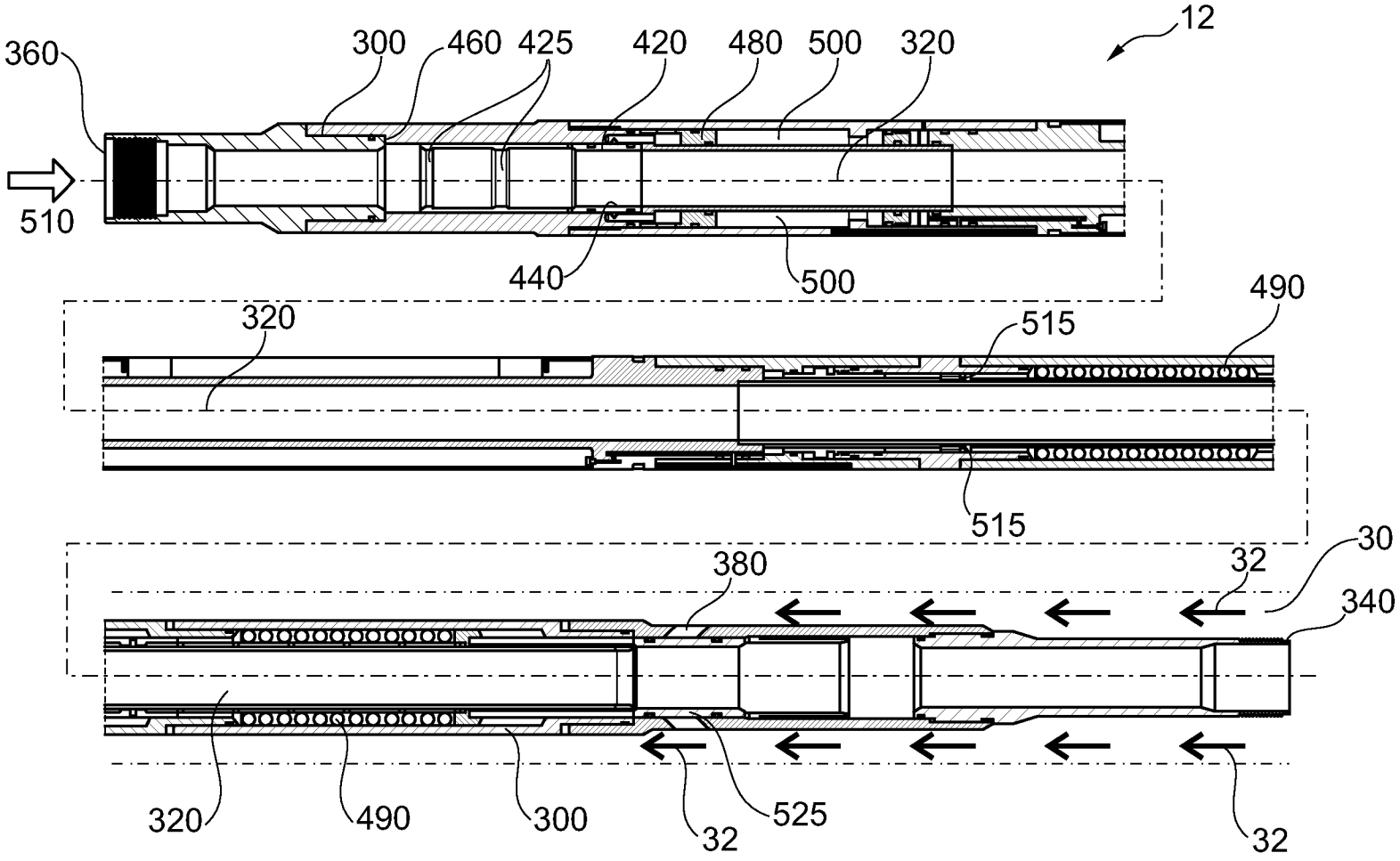
FIG. 4 is a schematic representation of a closed downhole valve assembly in accordance with an embodiment of the present invention.

FIG. 4 illustrates a bypass valve 12 in accordance with embodiments of the invention. The bypass valve 12 is shown in the closed state.

The bypass valve 12 comprises a tubular body 300, which includes an axial bore 320 between an inlet end 340 and an outlet end 360. The inlet 340 and the outlet 360 each comprise a threaded connector for attachment to a tubing mounted completion assembly or to the production tubing 22 of a downhole assembly.

The body 300 includes flow ports 380 extending through the body 300 in a substantially radial direction such that fluid can flow from outside the bypass valve 12 to inside the bypass valve 12 (see FIG. 6) as indicated by arrows 400.

The bypass valve assembly 12 includes a mechanically actuated sleeve 420 that moves by the action of retrieval/withdrawal of a washpipe or stinger from the completion assembly.

The washpipe or stinger (not illustrated) includes a mechanical coupling device such as collet fingers that are operable to engage with a profiled section 425 of the sleeve 420 such that the washpipe or stinger engages with and pulls the sleeve 420 as the washpipe or stinger is pulled from the completion assembly.

When the sleeve 420 reaches a stop 460 inside the body 300 the washpipe or stinger disengages from the sleeve 420. At the limit of its movement the sleeve 420 exposes and opens a port 440 to the axial passage 320 such that the bypass valve assembly 12 is in a primed state, wherein it is ready for operation in the event that the downhole valve assembly 10 fails to open.

Figure 5:
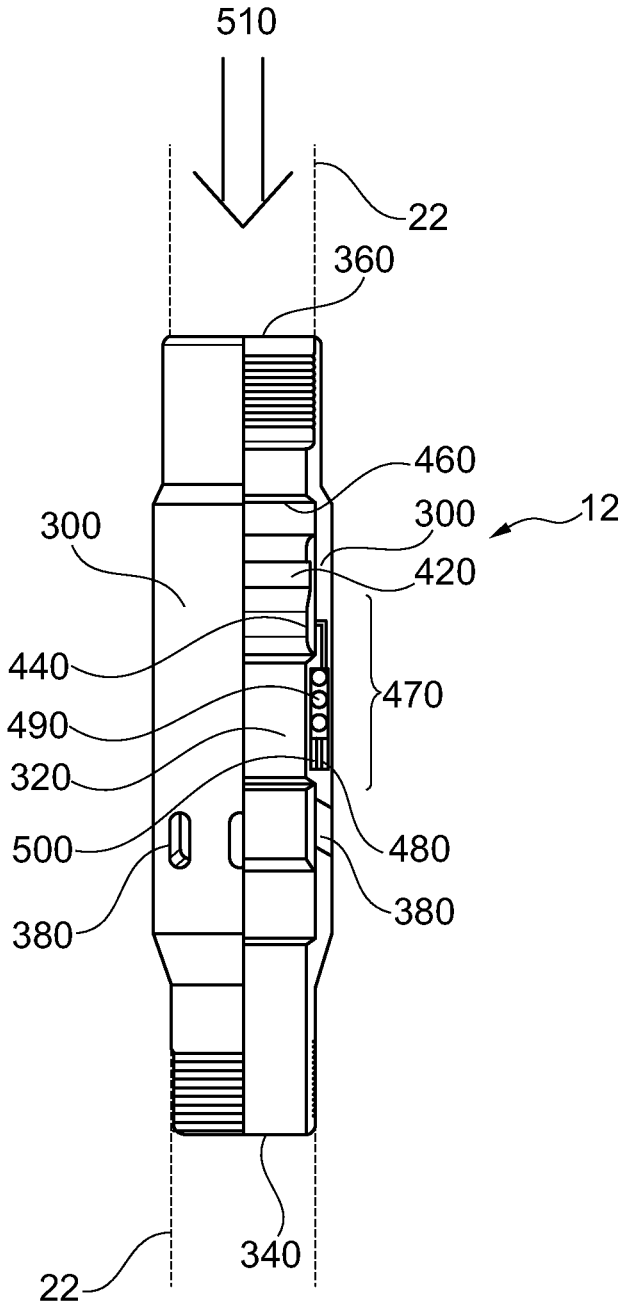
FIG. 5 is a schematic representation of a closed downhole valve assembly in accordance with an embodiment of the present invention.

The bypass valve assembly 12 comprises an internal hydraulic actuation mechanism 470, illustrated simply in FIG. 5 as a piston 480, a spring 490 and hydraulic fluid 500.

Figure 6:
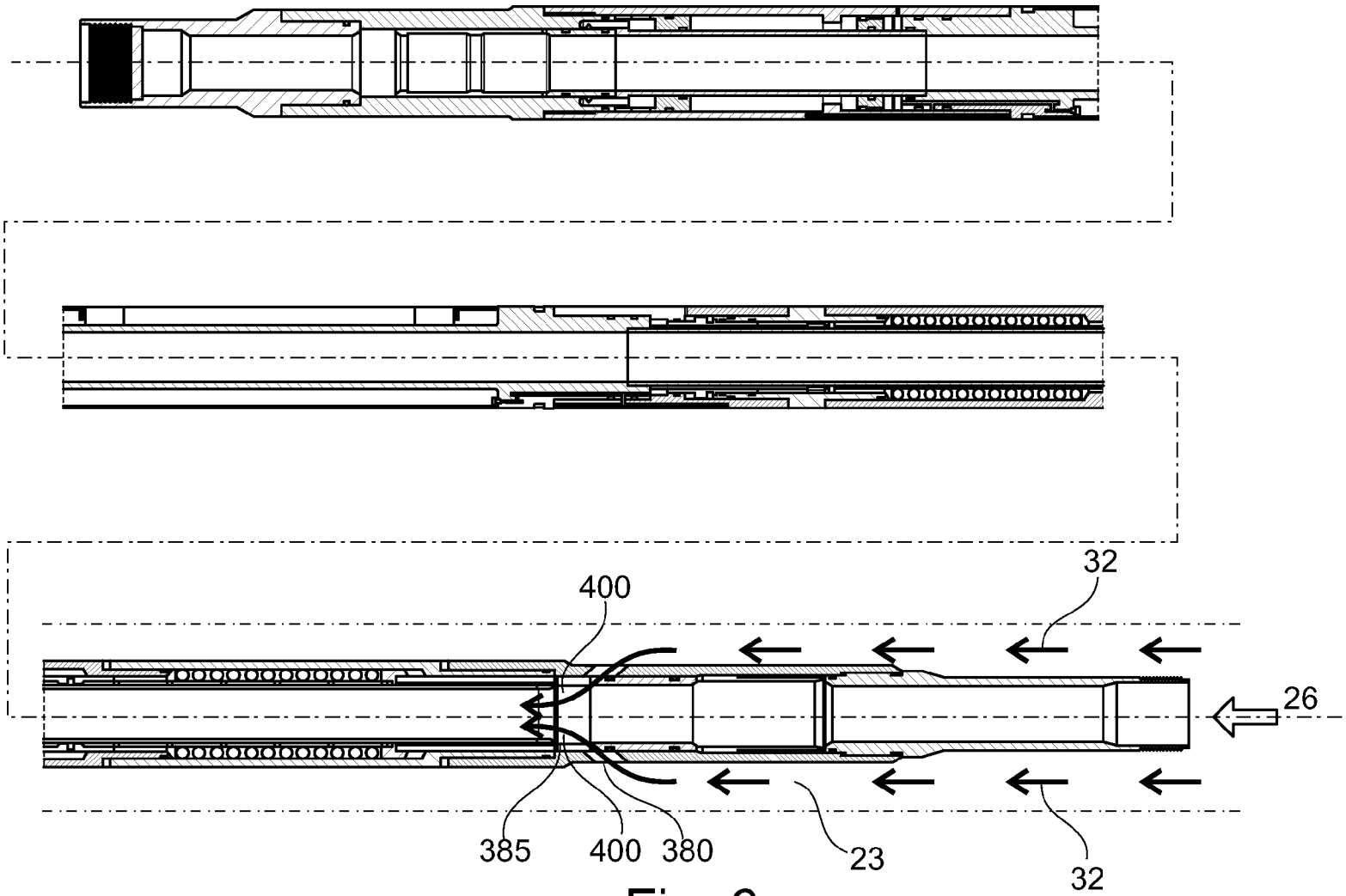
FIG. 6 is a schematic representation of an open downhole valve assembly in accordance with an embodiment of the present invention.

In the event that the downhole valve assembly 10 fails to open, the bypass valve 12 can be actuated by applying downhole tubing pressure 510 (see FIG. 4) which acts on the piston 480 via the port 440 such that movement of the piston 480 due to fluid pressure 510 displaces the hydraulic fluid 500 contained within the bypass valve 12 to cause a mechanism 515 to move which causes a compressed spring 490 to be released such that the spring 490 extends to complete the movement of the sleeve 525 by mechanical force exerted by the spring 490 on the sleeve 525 such that the flow ports 380 of the body 300 and corresponding ports 385 through the sleeve 320 are aligned (see FIG. 6). Alignment of the flow ports 380, 385 provides a flow path 400 through the bypass valve 12 to facilitate the diversion of fluid flow from the annulus 23 to fluid flow in the axial passage 320 of the bypass valve 12 and the production tubing 22 towards the surface.

As is illustrated in each of FIGS. 4, 5 and 6 the flow ports 380 are angled downwards from the inside to the outside of the bypass valve for smooth uninterrupted passage of production fluid from the downhole region of the production tubing towards the surface.

As described above with reference to FIGS. 3, 4, 5 and 6 annulus flow 32 is required such that production fluid can flow around an obstruction, such as a closed valve. Therefore, to restore production flow the bypass valve 12 diverts the annulus fluid flow 32 back into the axial passage 320 and the production tubing 22 beyond.

As described above with reference to FIG. 3 annulus flow 32 may be created by having a perforated joint 29 in the production tubing in a region below the area of a potential obstruction such as the downhole valve assembly 10.

Figure 7:
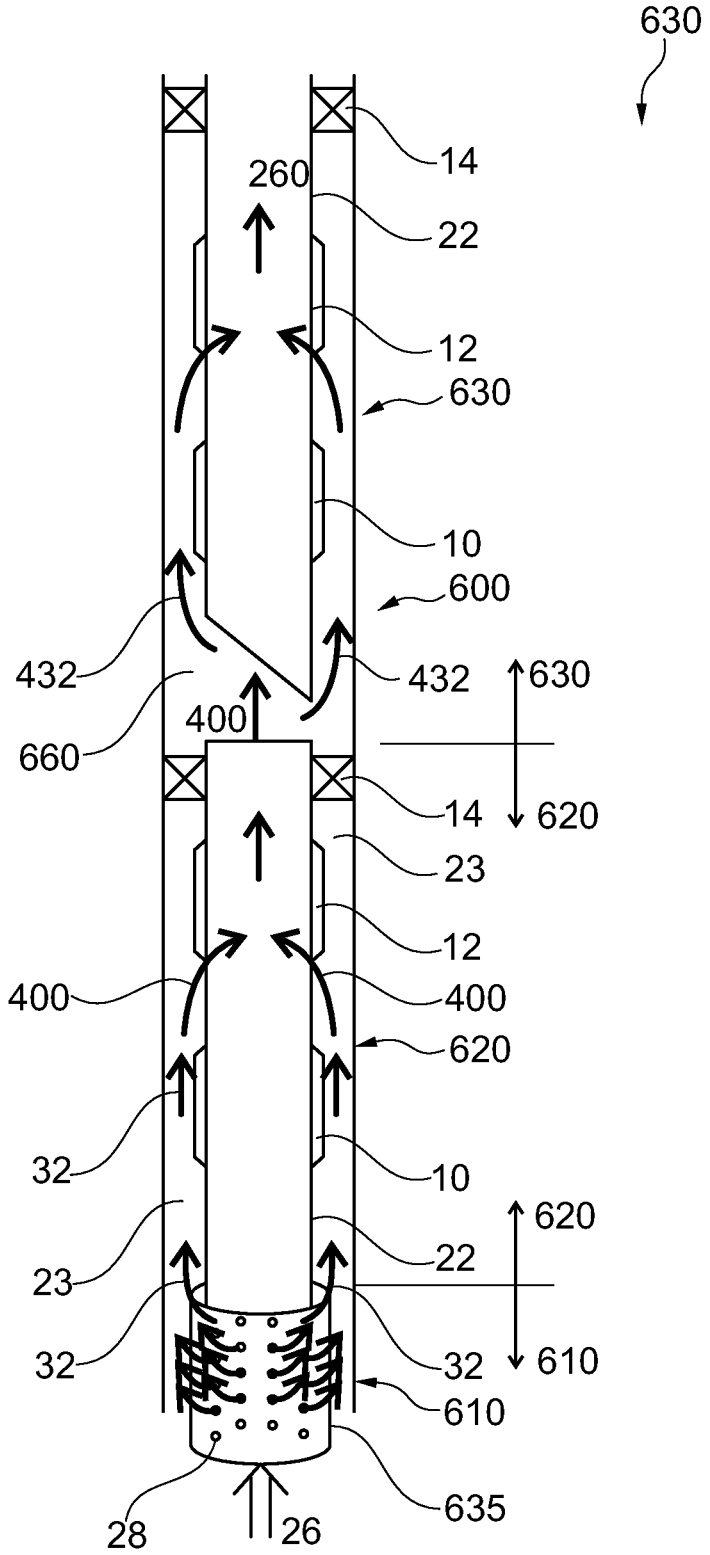
FIG. 7 is a schematic representation of a wellbore downhole completion assembly comprising a lower completion assembly, intermediate completion assembly, an upper completion assembly and including a downhole valve assembly in accordance with an embodiment of the present invention.

FIG. 7 illustrates a wellbore assembly 600 comprising a lower completion assembly 610, an intermediate completion assembly 620 and an upper completion assembly 630. The intermediate completion assembly 620 and the upper completion assembly 630 each comprise a downhole valve assembly 10, a bypass valve assembly 12 and a packer assembly 14 as described above with reference to FIGS. 1 to 6.

The lower completion assembly 610 and the intermediate completion assembly 620 are fluidly coupled and comprise a perforated joint 635, which comprises perforations 28 (see FIG. 3) to allow production fluid 26 to flow from inside the production tubing 22 to the annulus 23.

As can be seen from FIG. 7 the intermediate completion assembly 620 and the upper completion assembly 630 are not physically coupled together. Instead, a gap 660 is present between the intermediate completion assembly 620 and the upper completion assembly 630 such that the production fluid 400 exiting the intermediate completion 620 divides at the gap 660 to produce annulus flow 432 that can flow around the obstruction caused by the valve 10 failing to open.

The gap 660 or the distance between the intermediate completion 620 and the upper completion 630 may be in the region of nine to twelve meters (30-40 feet), but can be whatever distance that is deemed necessary.

Annulus flow is controlled and contained between zones 610, 620, 630 because of the sealing arrangement provided by each packer assembly 14.

The intermediate completion assembly 620 is generally engaged with a washpipe and run into the well/casing whilst the valve 10 is open. Upon completion of the intermediate completion assembly 620 and prior to installing the upper completion assembly 630 the washpipe is removed. Upon removal of the washpipe the bypass valve 12 is primed and ready as discussed above with reference to FIGS. 4, 5 and 6.

The upper completion assembly 630 is generally engaged with and run in to the well with a downhole tool such as a stinger (not shown). For workover of a well the stinger is removed and the valve 10 is closed, either mechanically upon removal of the stinger or in some other way, for example by electronic or hydraulic actuation. Upon removal of the stinger all control lines from the surface to the upper completion assembly 630 are disconnected and the bypass valve 12 according to embodiments of the invention is primed and ready for use to divert annulus flow 432 to tubing flow 260.

Therefore, following workover of a well, the bypass valve 12 can be used to restore a flow path 260 for production fluid as described above if attempts to reopen the valve 10 fail.

An advantage of the bypass valve 12 according to embodiments of the invention may be that production downtime due to a downhole obstruction, for example a failed valve, is minimal compared with the remedial methods described above. This is because the bypass valve 12 is primed for use on routine removal of a washpipe or stinger and the subsequent application of fluid pressure from the region uphole of the failed valve 10 opens the ports 380 such that annulus flow can bypass the obstruction and restores production flow.

Figure 8:
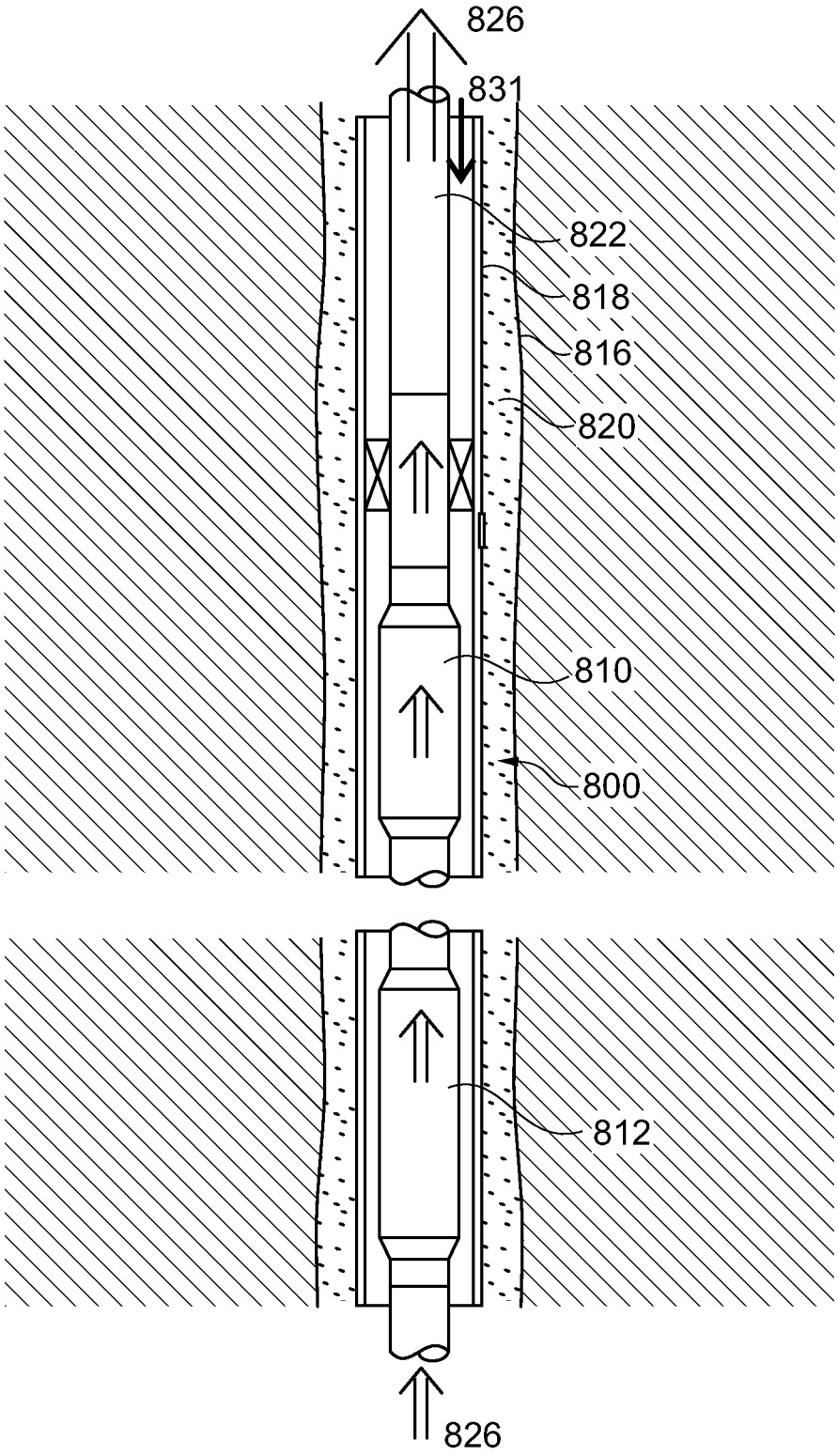
FIG. 8 is a schematic representation of a wellbore assembly comprising a downhole valve assembly in accordance with a second embodiment of the present invention.

FIG. 8 illustrates a partial longitudinal view of a wellbore completion arrangement 800 showing an application of a downhole valve assembly 812 according to a second embodiment of the present invention. Similar reference numerals have been applied and prefixed by the number eight.

The well completion arrangement 800 comprises a first downhole valve assembly 810 and a second downhole valve assembly 812.

The second downhole valve assembly 812 is representative of a downhole valve assembly in accordance with a second embodiment of the present invention. Therefore, the downhole valve assembly 812 will be hereinafter referred to as a bypass valve assembly 812.

Comparing FIG. 8 (of the second embodiment) with FIG. 1 (of the first embodiment) it is to be noted that in the well completion arrangement illustrated in FIG. 8 the packer assembly is omitted and that the bypass valve assembly 812 is located below the downhole valve assembly 810.

In the second embodiment a guide arrangement (not illustrated) is provided uphole of both the downhole valve assembly 810 and the bypass valve assembly 812 such that annulus flow is allowed, if and when required.

In FIG. 8 the wellbore 816 is constructed in the same way as the wellbore 16 illustrated in FIG. 1, where the wellbore 816 is lined with a casing 818, which is securely held in place with cement 820.

The downhole valve assembly 810 and the bypass valve assembly 812 are run into the well as part of the well completion assembly 800 on a running string that may include a stinger or washpipe (not illustrated).

In the illustrated embodiment the downhole valve assembly 810 is run-in in an open state and is subsequently closed when it has reached its location downhole. Once closed, fluid pressure can be applied from above the downhole valve assembly 810 to check the integrity of the tubing 822 and the well completion assembly 800. Following successful testing, the downhole valve assembly 810 can be opened such that production fluid can flow unimpeded through the downhole valve assembly 810 when the well is brought on line.

Primarily, the downhole valve assembly 810 can be opened by suitable means, for example fluid pressure from control lines to surface (not illustrated), mechanical actuation (not illustrated) or remote electronic actuation (not illustrated). Examples of suitable valves are ball valves and flapper valves.

As in the first embodiment, where the well is a producing well 800 comprising a downhole valve assembly 810 and the bypass valve assembly 812 according to a second embodiment of the invention, production fluid flows from a downhole location towards the surface as indicated by arrows 826. The normal path for production fluid is to flow, in the direction indicated by arrows 826, in the uphole direction, through the axial passage of the production tubing 822 and to pass unimpeded through the axial passage of the bypass valve assembly 812 and through the open axial passage of the downhole valve assembly 810 and continue to flow through the axial passage of the production tubing 822 towards the surface.

In the event that the downhole valve assembly 810 fails to open, and remains closed regardless of further attempts to open the downhole valve assembly 810, the bypass valve assembly 812 can be used to facilitate a diversion of production fluid flow past the failed valve assembly 810.

Figure 9:
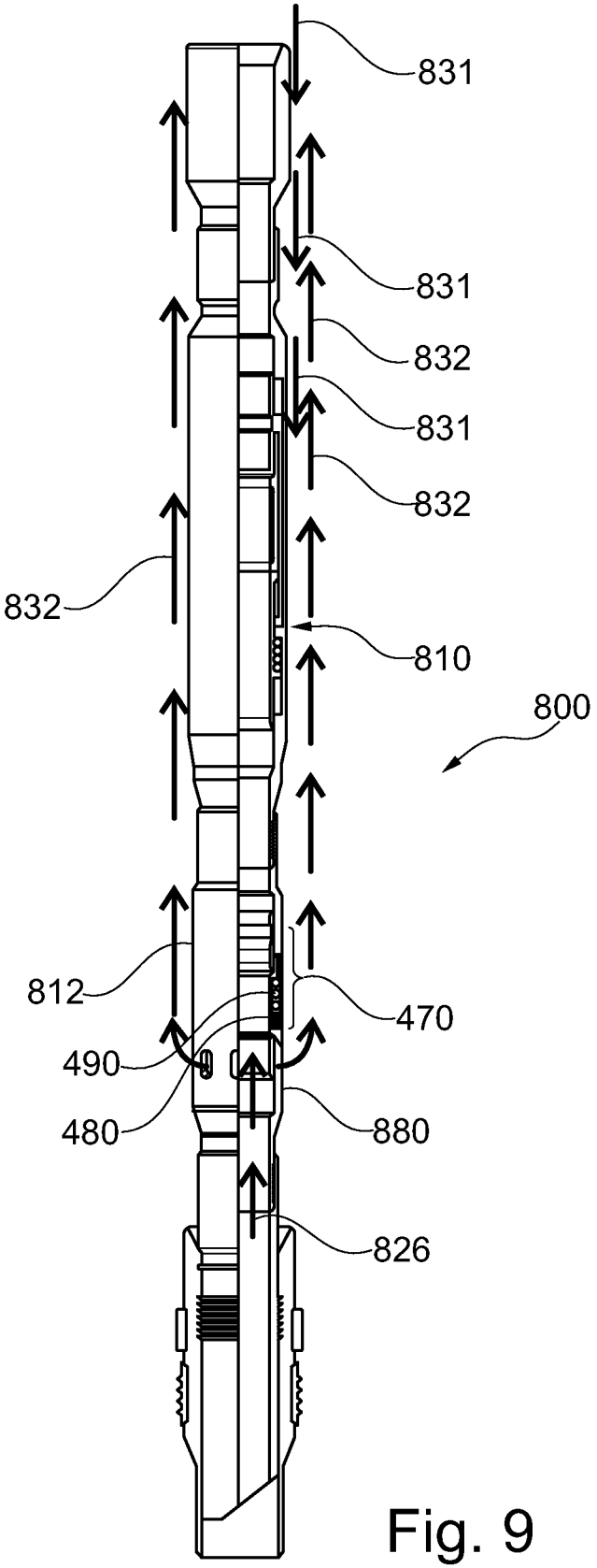
FIG. 9 is a further schematic representation of a wellbore assembly comprising a downhole valve assembly in accordance with a second embodiment of the present invention.

In the illustrated example the bypass valve 812 is located below the obstruction created by the closed valve 810 (as illustrated in FIG. 8 and FIG. 9).

Fluid pressure 831 applied via the annulus activates the internal mechanism of the annulus bypass valve 812 such that the annulus bypass valve 812 is actuated and opened and creates annulus flow, as indicated by arrows 832, in a region downhole of the downhole valve assembly 810.

The bypass valve assembly 812 facilitates diverting the production flow 826 through the open ports 880 in the body of the annulus bypass valve 812 to create annulus flow 832 that allows the flow of production fluid to continue uphole via the annulus region around the obstruction created by the closed downhole valve 810.

In the illustrated example, a packer is omitted from the tubing mounted completion assembly 800 and as such annulus flow 832 can continue, unimpeded to surface.

Figure 10:
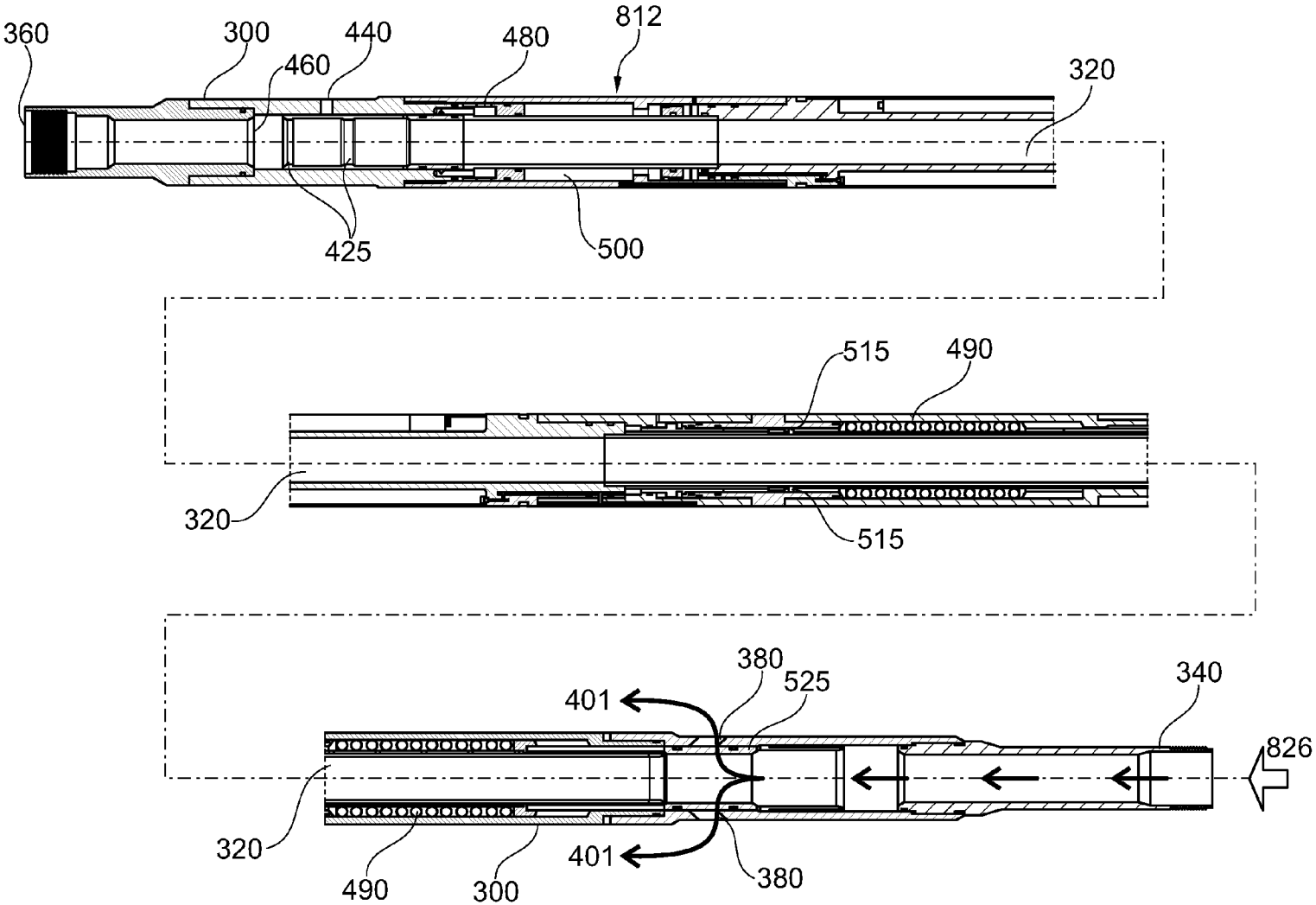
FIG. 10 is a schematic representation of a closed downhole valve assembly in accordance with a second embodiment of the present invention.

The bypass valve 812 according to the second embodiment comprises the same components as the bypass valve 12 according to the first embodiment and for clarity the features of the second embodiment are described by the following with reference to FIG. 10. Like reference numerals have been applied.

The bypass valve 812 comprises a tubular body 300, which includes an axial passage 320 between an inlet end 340 and an outlet end 360. The inlet 340 and the outlet 360 each comprise a threaded connector for attachment to other components of a tubing mounted completion assembly or the production tubing of a downhole assembly.

In the second embodiment, the body 300 includes flow ports 380 extending through the body 300 in a substantially radial direction such that production fluid can flow from inside the bypass valve 812 to outside the bypass valve 812 as indicated by arrow 401.

The bypass valve assembly 812 includes a mechanically actuated sleeve 420 that moves by the action of retrieval/withdrawal of a washpipe or stinger from the completion assembly to prime the bypass valve assembly 812. The bypass valve assembly 812 is prepared (primed) for operation in the event that the valve assembly 810 fails to open and is operational upon application of hydraulic pressure to open the ports in the body of the valve.

The washpipe or stinger (not illustrated) includes a mechanical coupling device such as collet fingers that are operable to engage with the profiled section 425 of the sleeve 420 such that the washpipe or stinger engages with and pulls the sleeve 420 as the washpipe or stinger is pulled from the completion assembly. When the sleeve 420 reaches a stop 460 inside the body 300 the washpipe or stinger disengages from the sleeve 420. At the limit of its movement the sleeve 420 opens a port 440 such that the bypass valve assembly 812 is primed and ready for operation in the event that the downhole valve assembly 10 fails to open.

Figure 11:
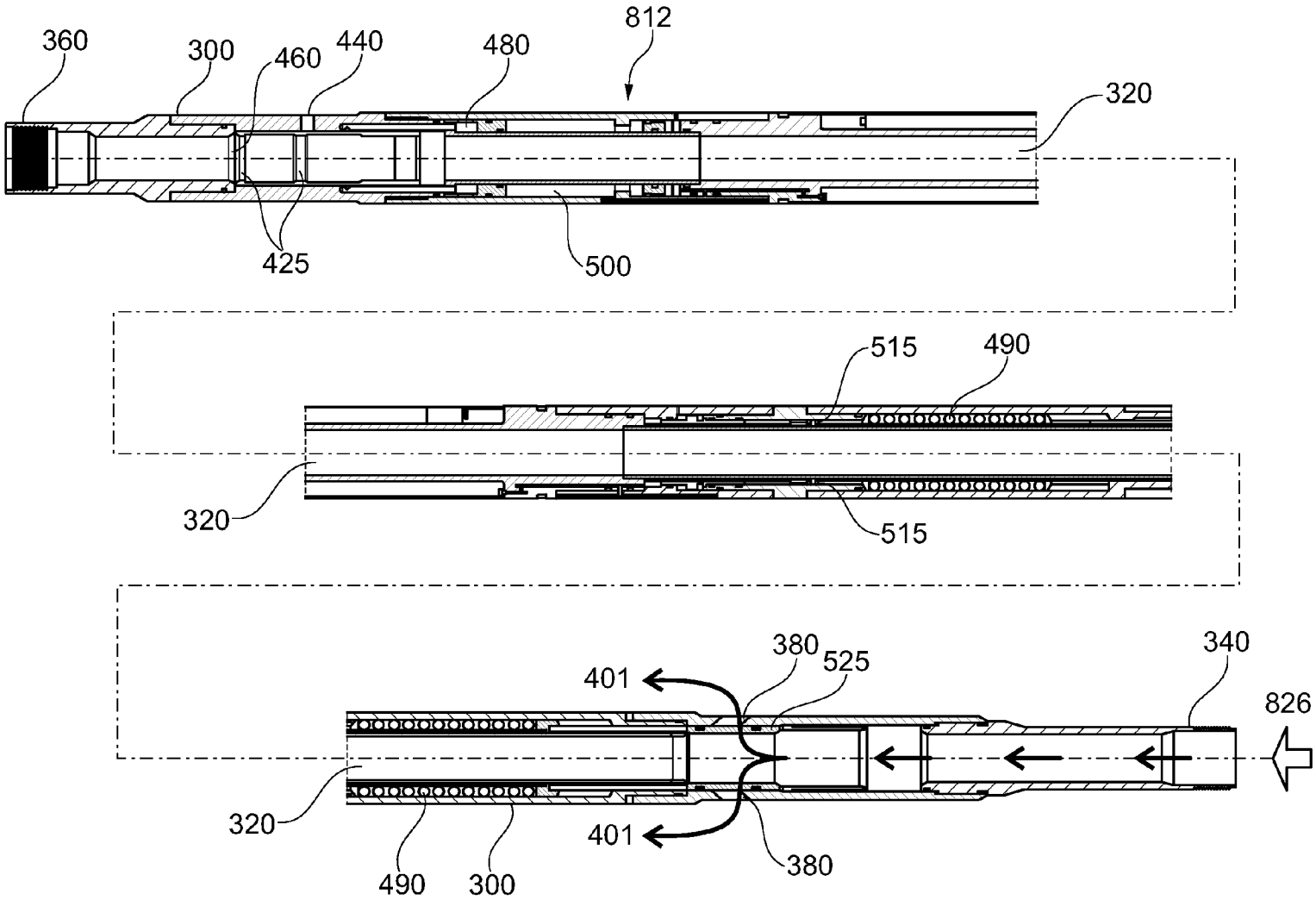
FIG. 11 is a schematic representation of an open downhole valve assembly in accordance with a second embodiment of the present invention

The bypass valve assembly 812 comprises an internal hydraulically actuated mechanism 470, which includes a piston 480, a spring 490 and hydraulic fluid 500 (see FIGS. 9, 10 and 11). A more detailed view of the components of the bypass valve is illustrated in FIG. 10 and FIG. 11.

Referring to FIGS. 10 and 11, in the event that the downhole valve assembly 810 fails to open, the bypass valve 812 is actuated by pressure applied via the annulus/upper production tubing. FIG. 10 illustrates the bypass valve 812 prior to actuation and FIG. 11 illustrates the bypass valve 812 when actuated. The fluid pressure is applied to the inside of the bypass valve 812 and the fluid acts upon the piston 480 via the port 440. The piston 480 is displaced such that the hydraulic fluid 500 contained within the bypass valve 812 is displaced, which subsequently causes a mechanism 515 to move which allows a compressed spring 490 to be released. The spring 490 extends to complete the movement of the sleeve 525, which operates to move to open the ports 380 such that a flow path 401 is defined through the bypass valve 812 to facilitate the diversion of production fluid flow from the axial passage 320 to the annulus.

Whilst specific embodiments of the present invention have been described above, it will be appreciated that departures from the described embodiments may still fall within the scope of the present invention.

What is claimed is:

1. A downhole valve assembly operable to control production fluid flow around an obstruction in a production tubing string; wherein the downhole valve assembly comprises:

a tubular body comprising an axial passage extending through the body;

one or more ports extending substantially radially through the body; and one or more actuating members operable to move relative to the body to selectively open the ports such that a fluid flow path through the ports is defined between an annulus region outside of the valve assembly and the axial passage, at least one of the actuating members comprises a mechanically actuated actuating member adapted for mechanical engagement with a retrievable downhole tool such that as the downhole tool is retrieved from a surrounding wellbore towards a terranean surface and removed from the downhole valve assembly, the mechanically actuated actuating member is simultaneously moved relative to the tubular body from a first position, in which the valve assembly is in an unprimed state where the ports are closed and further operation of the one or more actuating members to open the ports is inhibited; to a second position in which the valve assembly is in a primed state where the ports are closed and further operation of the one or more actuating members to open the ports is permitted.

2. The downhole valve assembly according to claim 1, wherein the mechanically actuated actuating member comprises a coupling member adapted to mechanically engage with a corresponding coupling member on the downhole tool.

3. The downhole valve assembly according to claim 2, wherein the coupling member of the mechanically actuated actuating member is engageable with the coupling member of the downhole tool upon removal of the downhole tool and wherein upon removal of the downhole tool the mechanically actuated actuating member is adapted to be moved from the first position to the second position and is adapted to disengage from the downhole tool at the second position.

4. The downhole valve assembly according to claim 1, wherein the ports remain closed when the mechanically actuated actuating member is in the second position.

5. The downhole valve assembly according to claim 1, further comprising a hydraulic actuator, a piston member and an inlet and an outlet.

6. The downhole valve assembly according to claim 5, wherein the inlet is closed when the mechanically actuated actuating member is in the first position and the inlet is open when the mechanically actuated actuating member is in the second position.

7. The downhole valve assembly according to claim 5, wherein the inlet is arranged in fluid communication with the axial passage of the body.

8. The downhole valve assembly according to claim 5, wherein the inlet is arranged in fluid communication with outside of the body.

9. The downhole valve assembly according to claim 5, wherein application of fluid pressure via the inlet acts upon the piston member, which acts to displace the hydraulic actuator thereby opening the ports.

10. The downhole valve assembly according to claim 9, wherein the hydraulic actuator comprises a spring.

11. The downhole valve assembly according to claim 9 wherein the hydraulic actuator comprises an electronically controlled pump.

12. The downhole valve assembly according to claim 9, wherein the hydraulic actuator comprises a hydraulic piston.

13. The downhole valve assembly according to claim 5, wherein the mechanically actuated actuating member and the hydraulic actuator are arranged within the tubular body.

14. The downhole valve assembly according to claim 13, wherein the mechanically actuated actuating member and the hydraulic actuator are adapted to move by sliding in an axial direction relative to the body.

15. The downhole valve assembly according to claim 5, wherein the hydraulic actuator comprises one or more fluid openings, wherein each opening is arranged to align with a corresponding port through the tubular body thereby defining a flow path between an annulus region outside of the valve and the axial passage.

16. The downhole valve assembly according to claim 15, wherein the ports through the tubular body are inclined relative to the axis of the body.

17. The downhole valve assembly according to claim 16, wherein the ports incline in an uphole direction from outside to inside the body and the flow path is defined from outside the body to inside the axial passage.

18. The downhole valve assembly according to claim 16, wherein the ports incline in a downhole direction from inside to outside the body wherein the fluid flow path is defined from inside the body to outside the body.

19. A method of controlling and diverting fluid flow around an obstruction in a production tubing string, wherein the method comprises:

locating a valve assembly in a wellbore, wherein the valve assembly comprises a tubular body comprising an axial passage extending through the body, one or more ports extending substantially radially through the body; and one or more actuating members operable to move relative to the body to selectively open the ports such that a fluid flow path through the ports is defined between an annulus region outside of the valve and the axial passage, at least one of the actuating members comprising a mechanically actuated actuating member adapted for mechanical engagement with a retrievable downhole tool;

moving, as the downhole tool is retrieved from the wellbore towards a terranean surface and removed from the valve assembly, the mechanically actuated actuating member from a first position relative to the tubular body, in which the valve assembly is in an unprimed state where the ports are closed and further operation of the one or more actuating members is inhibited, to a second position in which the valve assembly is in a primed state where the ports are closed and further operation of the one or more actuating members is permitted to open the ports; and with the mechanically actuated actuating member in the second position, moving one of the actuating members relative to the body to open the ports such that a fluid flow path for production fluid is defined; wherein the fluid flow path is defined between an annulus region outside of the valve and the axial passage.

20. The method according to claim 19, further comprising:

engaging the mechanically actuated actuating member with a retrievable downhole tool;

moving the mechanically actuated actuating member from the first position to the second position; and disengaging the mechanically actuated actuating member from the retrievable downhole tool.

21. The method according to claim 20, wherein at least one of the one or more actuating members comprises a hydraulic actuator comprising at least a piston member, a fluid inlet and a fluid outlet and the method further comprises:

applying fluid pressure via the axial passage or annulus and the inlet such that the fluid pressure acts upon the piston to selectively open the ports such that a fluid flow path for production fluid is defined through the body of the valve assembly.

* * * * *